US005090614A

United States Patent [19]

Kupersmit

[11] Patent Number: 5,090,614

[45] Date of Patent: Feb. 25, 1992

[54] COLLAPSIBLE REINFORCED SHIPPING CARTON WITH FOLDABLE SLIP SHEET

[76] Inventor: Julius B. Kupersmit, 299 W. 12th St., New York, N.Y. 10014

[21] Appl. No.: 716,260

[22] Filed: Jun. 17, 1991

[51] Int. Cl.[5] ..... B65D 88/22; B65D 88/52

[52] U.S. Cl. ..... 229/117.04; 220/416; 229/23 A; 229/117.05; 229/125.39

[58] Field of Search ..... 229/33 R, 23 A, 125.39, 229/185, 117.04, 117.05; 220/416, 418

[56] References Cited

U.S. PATENT DOCUMENTS

| | | | |
|---|---|---|---|
| 2,226,050 | 12/1940 | Chanbliss et al. | 229/23 R |
| 2,678,766 | 5/1954 | Leukoff | 229/117.05 |
| 3,007,622 | 11/1961 | George | 229/23 R |
| 3,565,325 | 2/1971 | Pugsley | 229/117.05 |
| 3,642,192 | 2/1972 | Wilcox, Jr. et al. | 229/117.05 |
| 4,138,053 | 2/1979 | Gardner | 229/23 R |
| 4,333,602 | 6/1982 | Geschwender | 229/125.39 |
| 4,411,373 | 10/1983 | Kupersmit | 229/117.04 |
| 4,595,137 | 6/1986 | Kupersmit | 229/117.05 |
| 4,709,852 | 12/1987 | Stoll | 229/185 |

FOREIGN PATENT DOCUMENTS

| | | | |
|---|---|---|---|
| 158992 | 10/1985 | European Pat. Off. | 229/117.05 |
| 718448 | 11/1954 | United Kingdom | 229/117.05 |

*Primary Examiner*—Gary E. Elkins
*Attorney, Agent, or Firm*—Charles E. Temko

[57] ABSTRACT

A collapsible shipping container with integral folding slip sheet. Foldable interior walls provide double wall thickness at two of four oppositely disposed side walls, the double wall thickness also serving to reinforce the container against compressive forces at each of four corners. A flap-type lower wall is provided with a permanently attached foldable slip sheet to facilitate fork lift engagement. In a first embodiment, a lid or cover is also formed integrally and foldably attached to an upper peripheral edge along one rectilinear segment thereof. In another embodiment, hook and pile fasteners interconnect the flaps and slip sheet forming the lower wall to maintain the container in erected condition.

4 Claims, 9 Drawing Sheets

FIG. 1
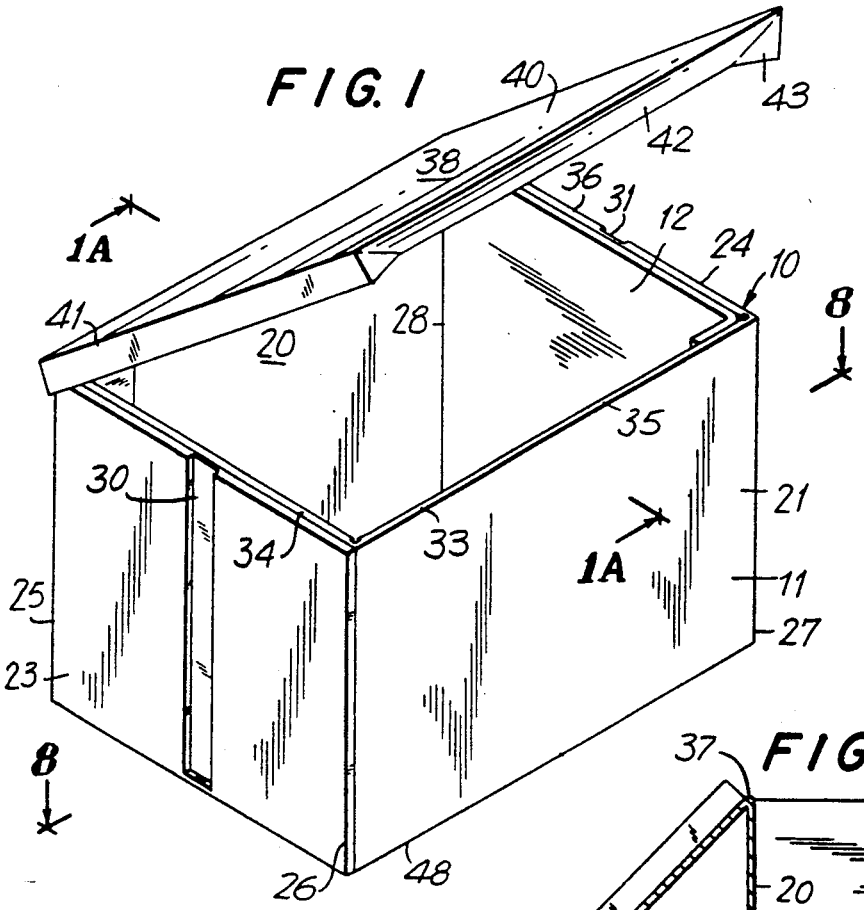
FIG. 1A
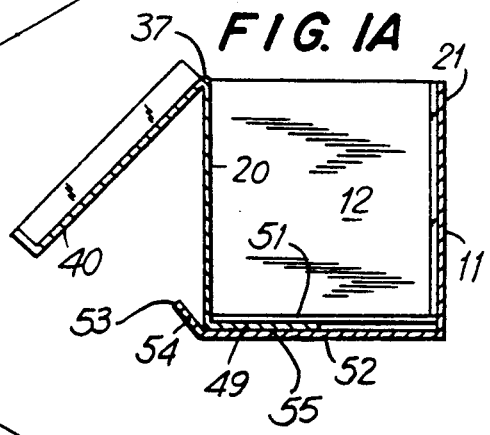
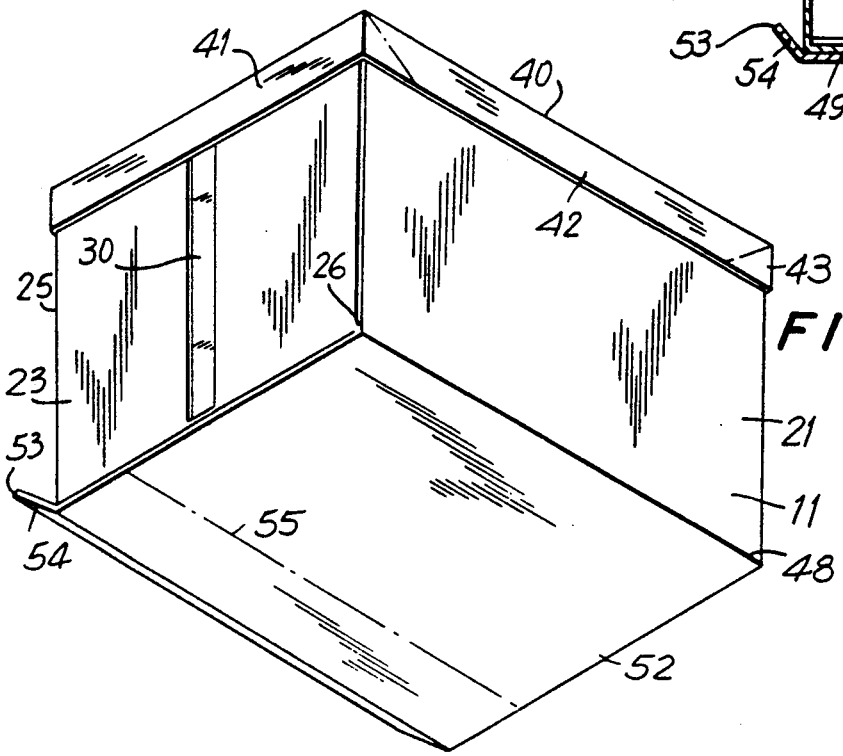
FIG. 2

FIG. 7
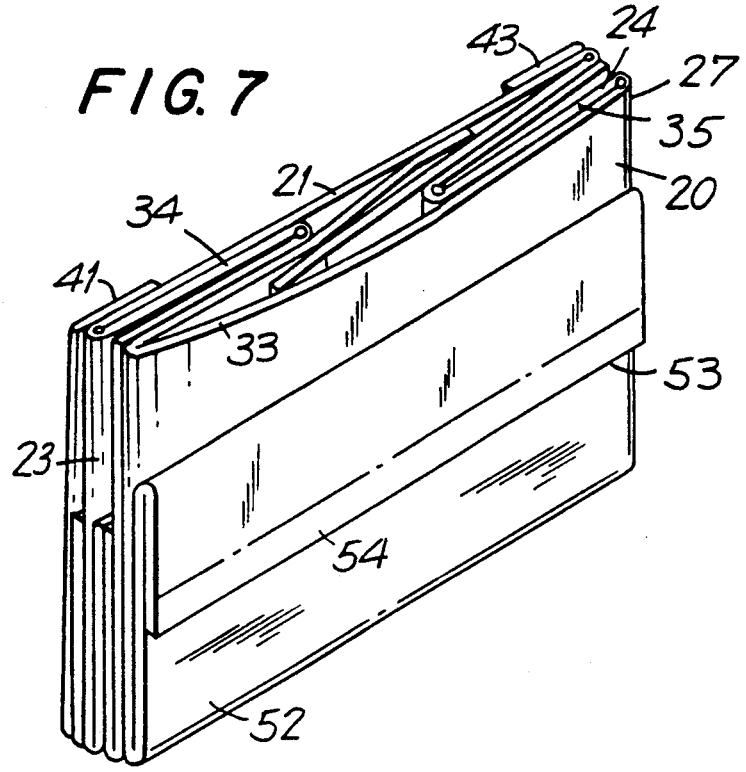
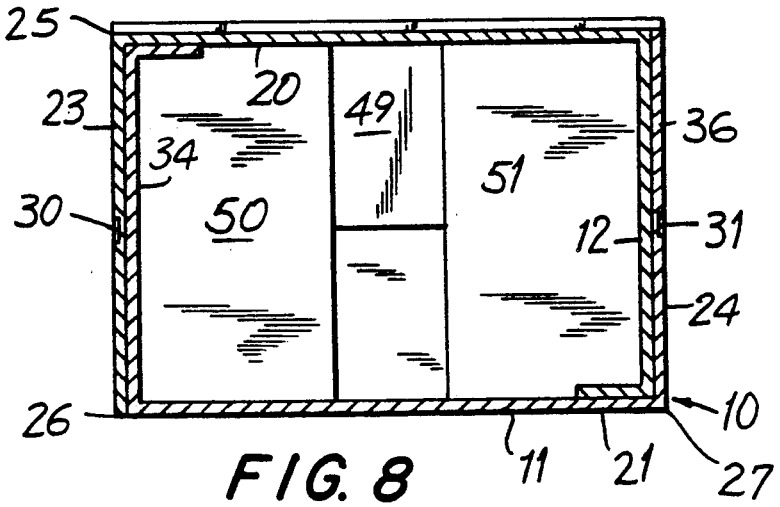
FIG. 8

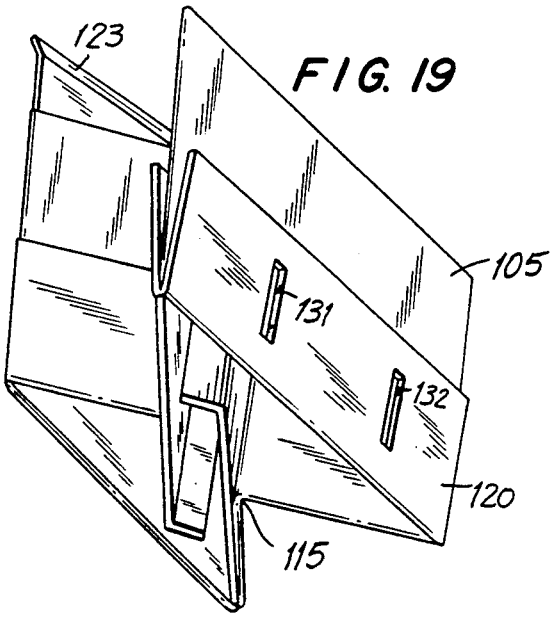
FIG. 19
FIG. 20
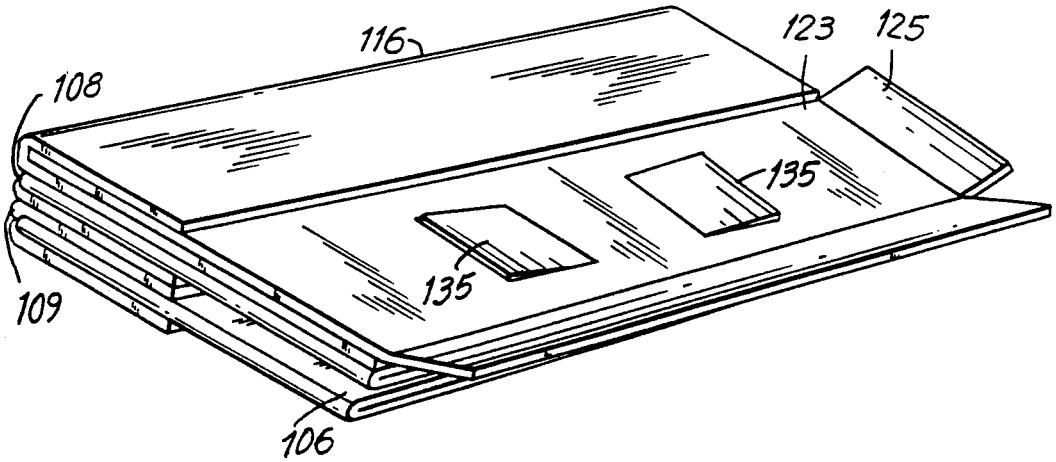

COLLAPSIBLE REINFORCED SHIPPING CARTON WITH FOLDABLE SLIP SHEET

BACKGROUND OF THE INVENTION

This invention relates generally to the field of collapsible reusable shipping containers particularly suited for shipping liquids and particulate materials using a foldable baglike inner container. Devices of this general type are known in the art, and the invention lies in specific constructional details which permit improved ease of assembly and disassembly, reduction in manufacturing costs, and a reduction in overall size in collapsed condition which has heretofore been unobtainable.

In my prior U.S. Pat. No. 4,663,207, granted Aug. 17, 1986 under the title Reinforcing Element for Collapsible Containers, there is disclosed a foldable unit for use with single ply or multiple ply corrugated containers. The insert in folded condition is disposed with the folded container with which it is used to, therefore, require very little additional storage space. The insert element is constructed to include inner and outer walls. The outer walls fold along vertical generally medially disposed fold lines. The inner walls are laminated to the inner surface of the outer walls on one side of the fold lines to prevent folding in only a single direction, and are provided with foldable narrow flaps, the fold lines of which are disposed in the corners of the insert when the element is in assembled or erected condition. Using materials commensurate with the overall size of the container and the expected compressive loads, the result is a collapsible container of strength far in excess of that normally expected in conventional collapsible container construction.

Certain types of cargo are not subject to damage by breakage or crushing due to externally applied forces. Liquids and particulate cargos, in particular, are usually damaged as a result of leakage, spoilage, and the like. For such goods, the prime consideration is resistance to internal pressure caused by the weight of the load resulting in bulging, and potential leakage caused by damage to the container. While such containers require capability to resist compressive forces, the compression is usually the result of stacking containers in loaded condition, one upon another. When such cargos are shipped in containers with separate liner elements, the result is excess cost of manufacture, unneeded and unnecessary shipping weight, and greater-than-necessary storage volume when the container is in collapsed condition.

SUMMARY OF THE INVENTION

Briefly stated, the invention contemplates the provision of an improved collapsible shipping container of the class described, in which the above-mentioned disadvantages have been substantially reduced.

To this end, the disclosed embodiment incorporates the structural advantages of the above-described liner construction while eliminating the necessity of a separate liner element. The container incorporates a pair of foldable oppositely disposed laminated side walls, which are laminated only on one side of a medially-disposed fold line. The inner lamina is bounded by a first vertical edge on the laminated side extending to a vertical corner of the container, and a second edge on the unlaminated side is bounded by a fold edge supporting a narrow flap, the edge extending into and reinforcing a corresponding corner of the erected container. The container includes an integral cover or lid foldably connected to an upper edge periphery, and an integral slip-sheet foldably interconnected to a lower peripheral edge. Thus, when the container is collapsed, all of the component parts are reduced to parallel flattened condition to occupy a minimum of storage space, with none of the parts in completely disassociated condition.

BRIEF DESCRIPTION OF THE DRAWING

In the drawing, to which reference will be made in the specification, similar reference characters have been employed to designate corresponding parts throughout the several views.

FIG. 1 is a top plan view of a first embodiment of the invention in erected condition, with an integral cover element in opened condition.

FIG. 1A is a sectional view as seen from the plane **1*a*—1*a* in FIG. 1**.

FIG. 2 is a bottom perspective view of the embodiment with the cover element in closed condition.

FIG. 7 is a perspective view showing a fifth stage of disassembly.

FIG. 8 is a horizontal sectional view as seen from the plane 8—8 in FIG. 1.

FIG. 19 is a perspective view showing a fifth and final stage of disassembly.

FIG. 20 is a perspective view showing a fully flattened second embodiment.

DETAILED DESCRIPTION OF THE DISCLOSED EMBODIMENTS

Figure 3:
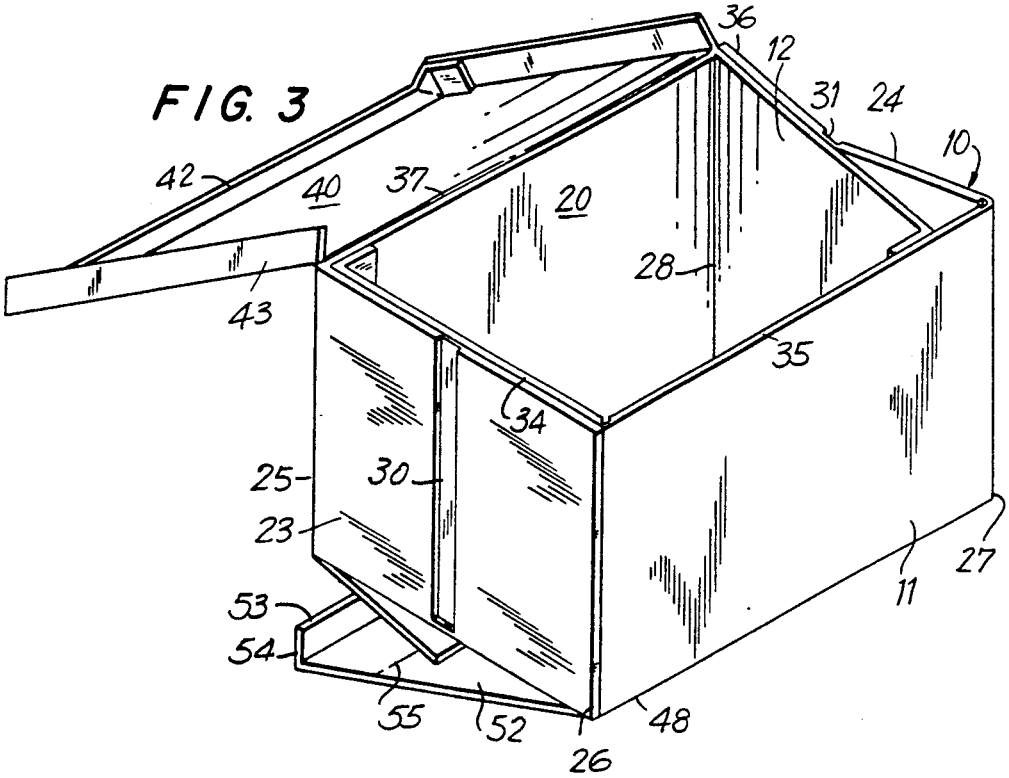
FIG. 3 is a perspective view showing a first stage of disassembly.

In accordance with the first embodiment of the invention, the device, generally indicated by reference character 10, comprises broadly, a first outer lamina 11 and a second inner lamina 12.

The outer lamina 11 is formed from a unitary blank of fibrous material, either solid or corrugated, and includes first and second oppositely disposed rigid walls 20 and 21. These are interconnected to third and fourth foldable walls 23 and 24, respectively, at four vertical parallel edges 25, 26, 27 and 28.

The walls 23 and 24 each include medially disposed fold lines 30 and 31, respectively, and with the walls 20 and 21, they form a continuous upper peripheral edge 33 including free edge segments 34, 35, and 36, and a fold line segment 37 hingedly interconnecting an integral cover element 38.

The cover element 38 is adapted to overlie the container in closed condition, and may be of any desired configuration including a main horizontal wall 40, and interconnected foldable flap members 41, 42, and 43.

The walls 20-21 and 23-24 also form a continuous lower peripheral edge 48 which support a first flap member 49, a second flap member 50 and a third flap member 51. In lieu of a fourth flap is a slip-sheet member 52 having a distal free edge 53 which extends outwardly of the plane of the first wall 20 and includes a folded flap 54 to facilitate engagement with a fork lift (not shown) of known type. In order that the slip-sheet not extend beyond the boundaries of the folded container, it also includes a medially positioned transversely extending fold line 55.

The inner lamina 12 includes first and second identical elements 60 and 61 which may be each formed in one or two parts, which are partially laminated to the outer lamina 11. Each element includes a first wall 62 which is fully laminated to an inner surface of a first or second wall 20-21. Each includes a second wall 64 which is partially laminated to a corresponding third or fourth wall 23-24 only on one side of the corresponding fold line 30-31. The unlaminated portion 58 includes a fold edge 69 supporting a narrow flap 70 which serves to reinforce one of the four corners defined by the edges 25-28, inclusive.

Figure 4:
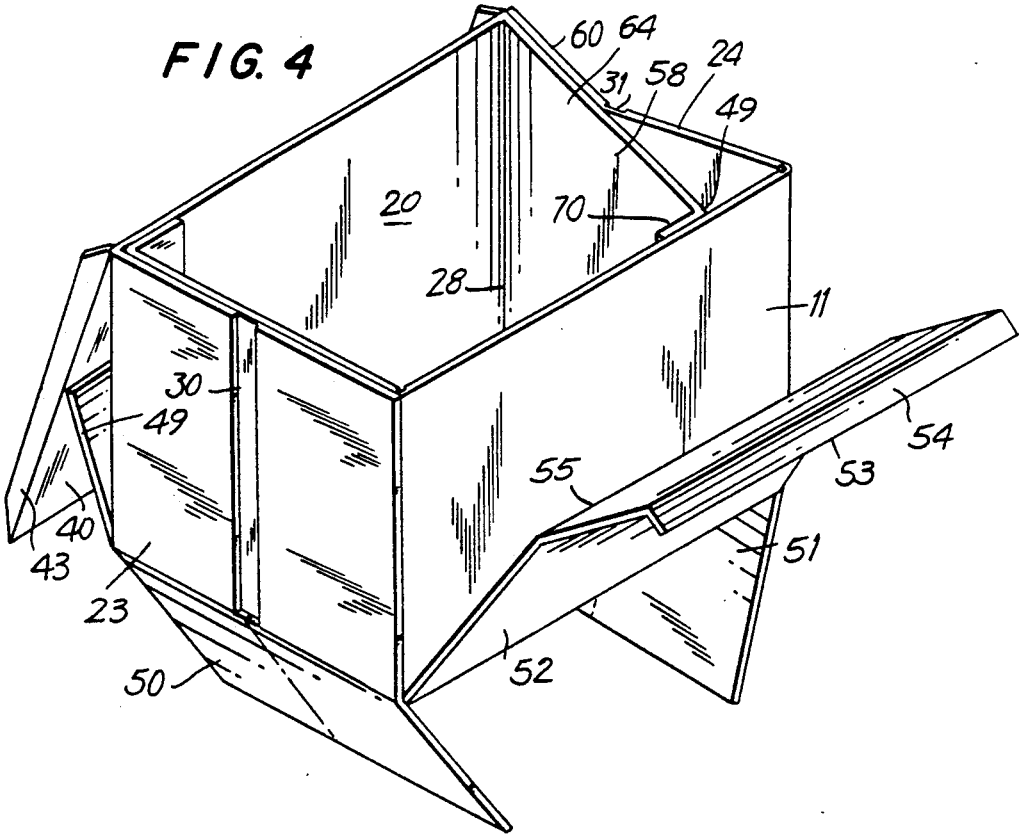
FIG. 4 is a perspective view showing a second stage of disassembly.
Figure 5:
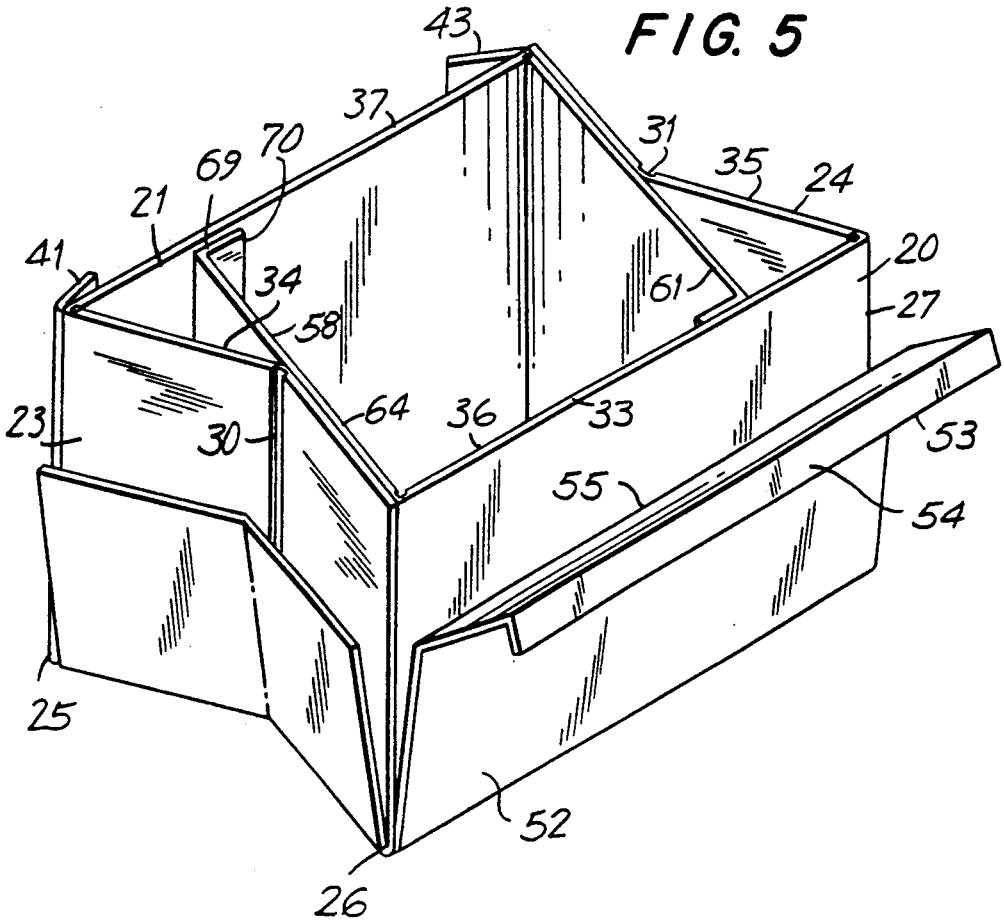
FIG. 5 is a perspective view showing a third stage of disassembly.
Figure 6:
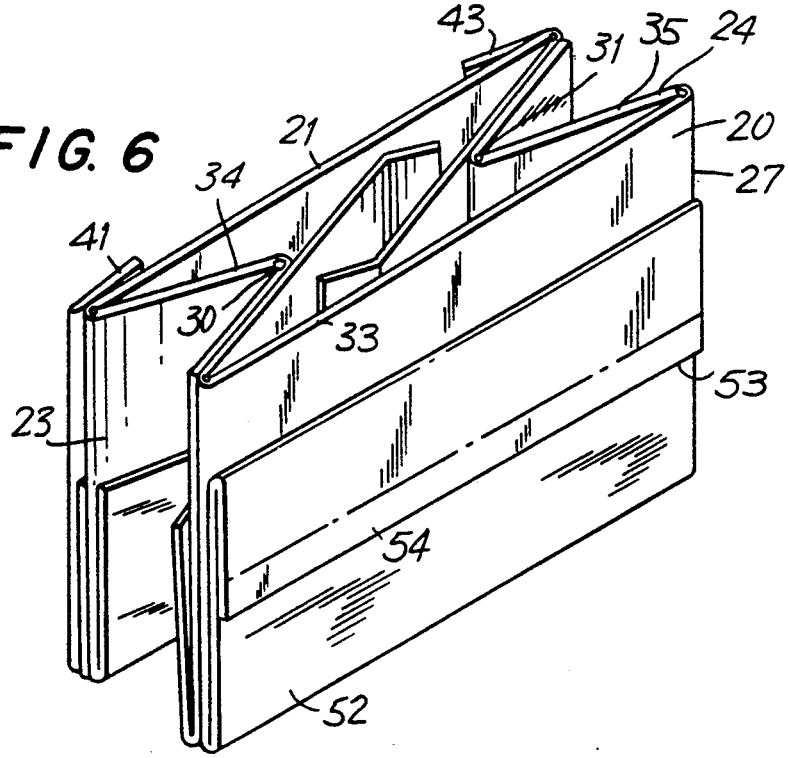
FIG. 6 is a perspective view showing a fourth stage of disassembly.
Figure 9:
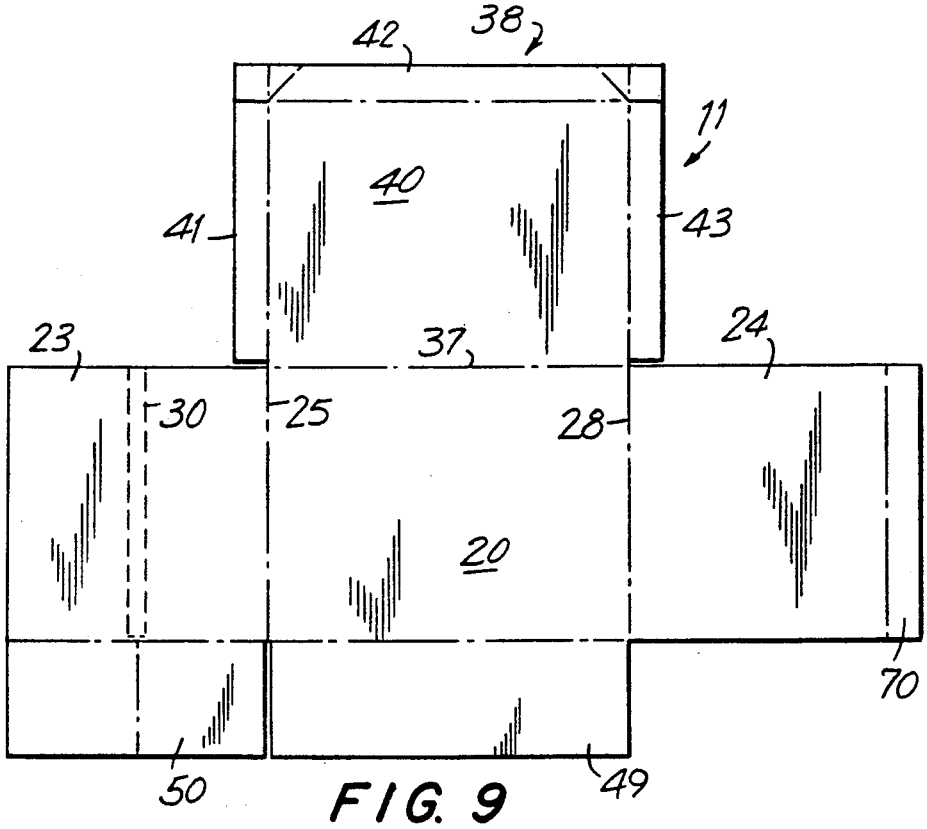
FIG. 9 is a developed view of a first lamina forming part of the embodiment.
Figure 10:
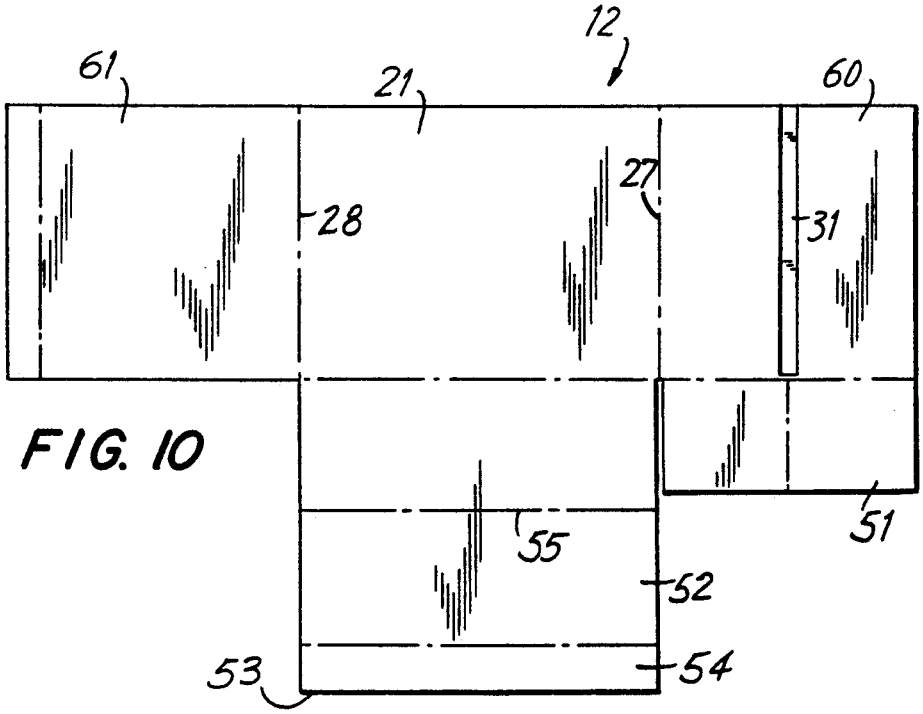
FIG. 10 is a developed view of a second lamina part of the embodiment.

From a consideration of FIGS. 4 through 7, inclusive, it will be apparent that the device in collapsed condition occupies an area generally equivalent to that of the wall 20, with a thickness corresponding to the number of folded members which are placed in superimposed condition. The flaps and slip-sheet associated with the lower peripheral edge are folded against the outer surfaces of the corresponding wall with which they are associated, and the cover element 38 is also folded upon itself in a similar fashion, with the flap members 41 and 43 folded upon the wall 40.

To move the device to erected condition, the fold lines 30 and 31 are used to pivot the walls 23 and 24 to single planar condition, at which point the flaps 49, 50, and 51 and slip-sheet 52 are freed for pivotal movement to form the bottom wall of the container. This movement will also serve to align the unattached portions of the inner lamina 12 with corresponding surfaces on the outer lamina 11. The device may then be filled with cargo, following which the cover element 38 is pivoted to overlie the upper peripheral edge 33 to effect closure. In the case of particulate or liquid cargo, it is usual to use a synthetic resinous bag or sack (not shown) to prevent leakage.

When the container has been unloaded, it can be again returned to collapsed condition in the reverse order of the steps described above for return shipment.

Figure 11:
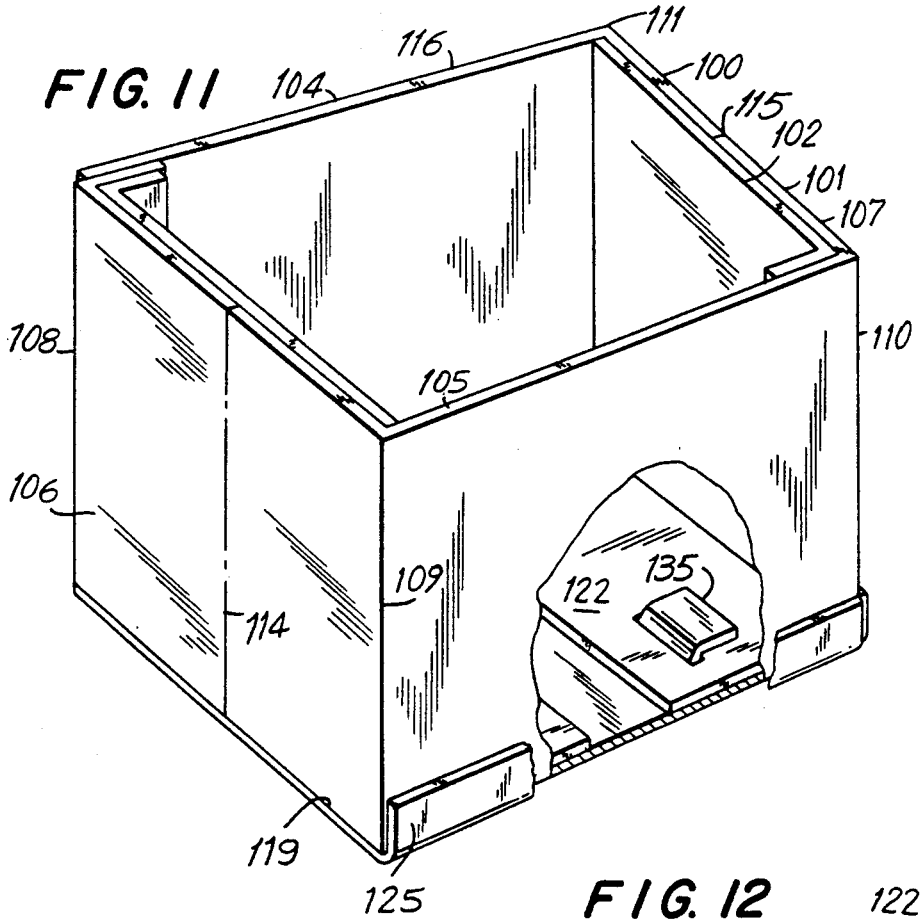
FIG. 11 is a perspective view, partially broken away to show detail of a second embodiment of the invention.
Figure 12:
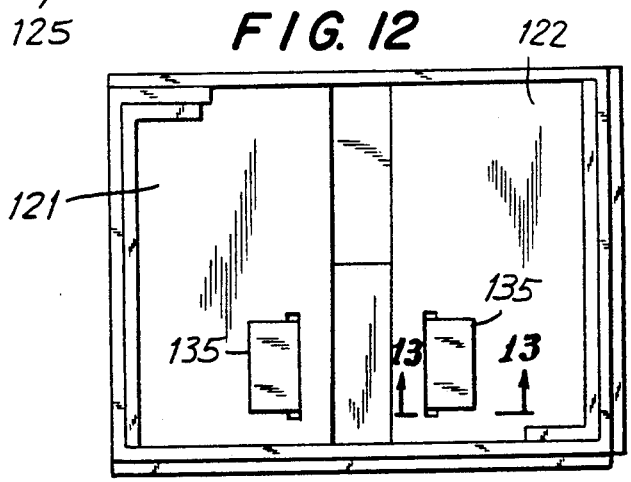
FIG. 12 is a top plan view of the second embodiment.
Figure 13:
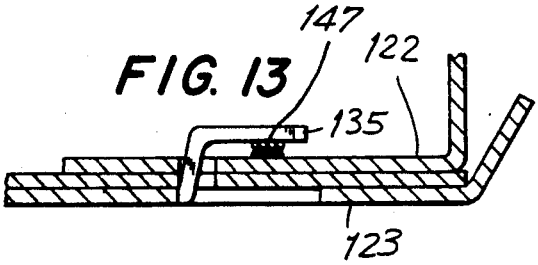
FIG. 13 is a fragmentary sectional view as seen from the plane 13—13 in FIG. 12.
Figure 14:
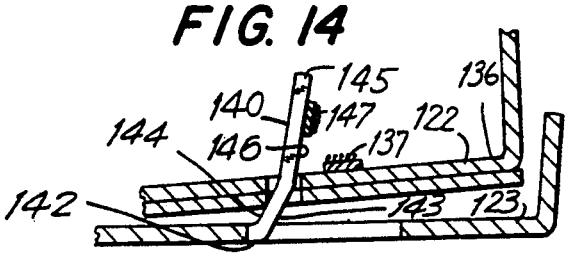
FIG. 14 is a similar fragmentary sectional view showing a first stage of disassembly.
Figure 15:
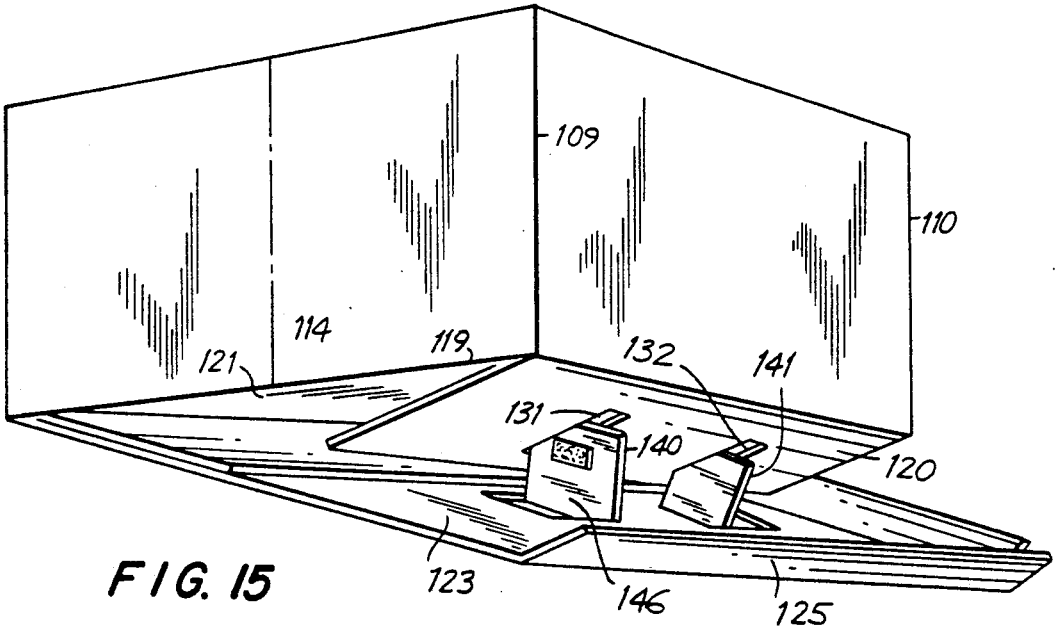
FIG. 15 is a perspective view showing said first stage of disassembly.
Figure 16:
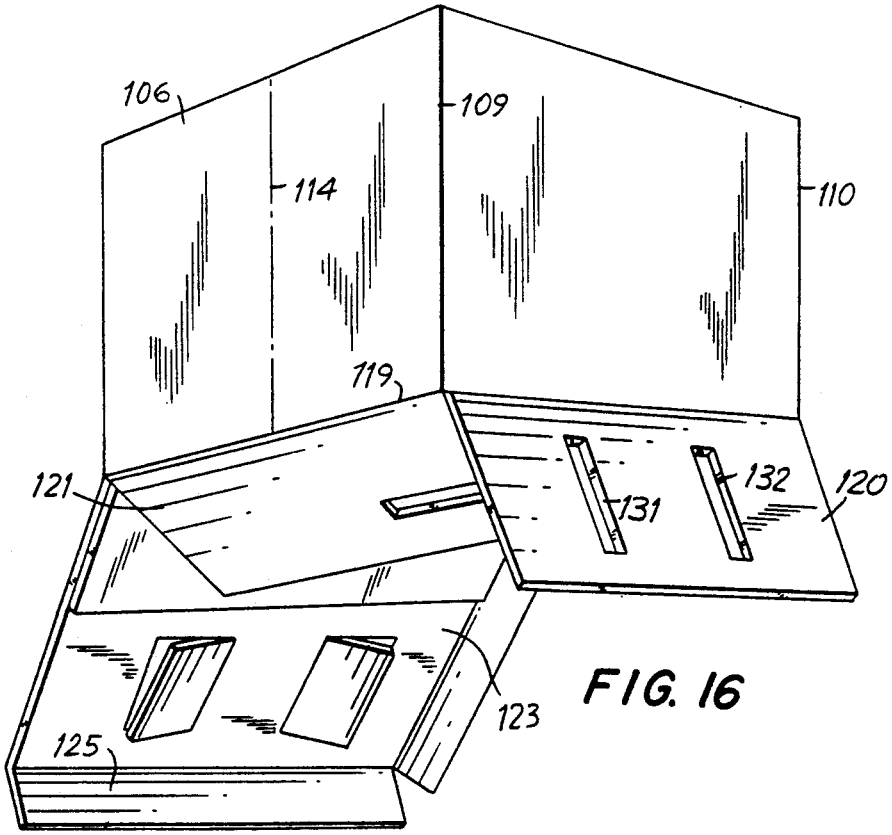
FIG. 16 is a perspective view showing a second stage of disassembly.
Figure 17:
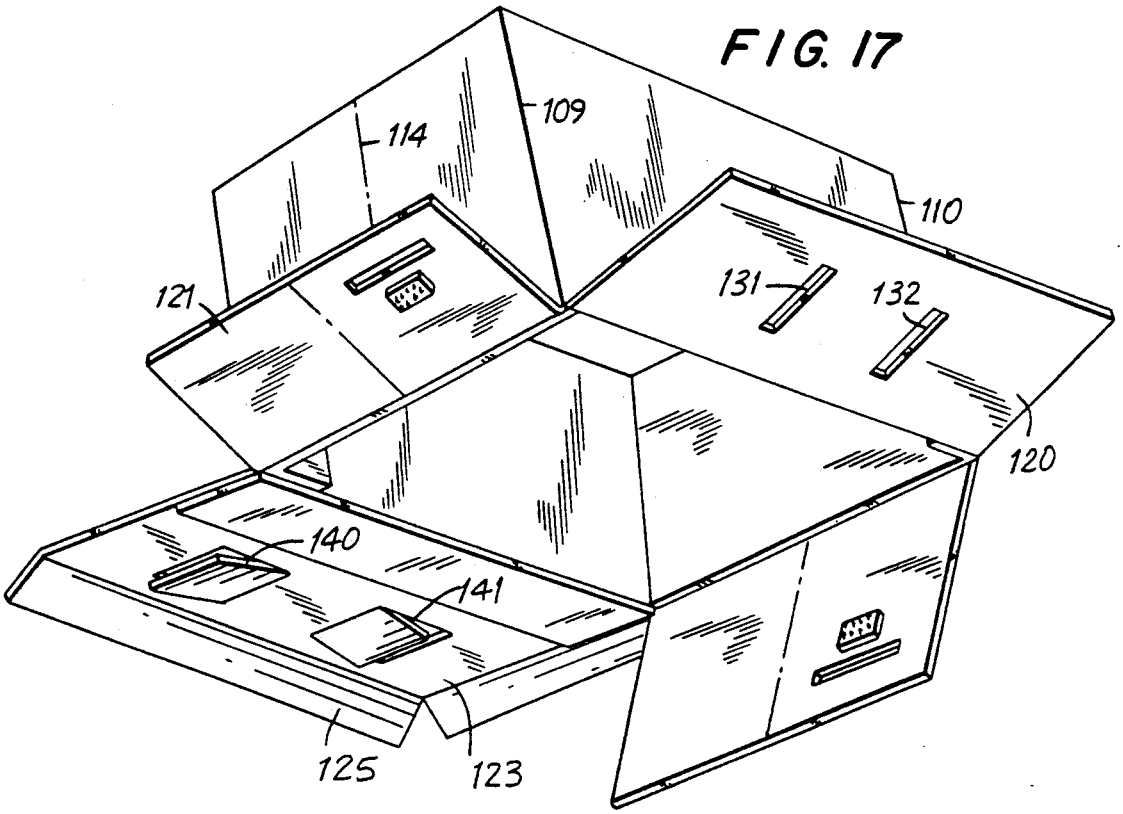
FIG. 17 is a perspective view showing a third stage of disassembly.
Figure 18:
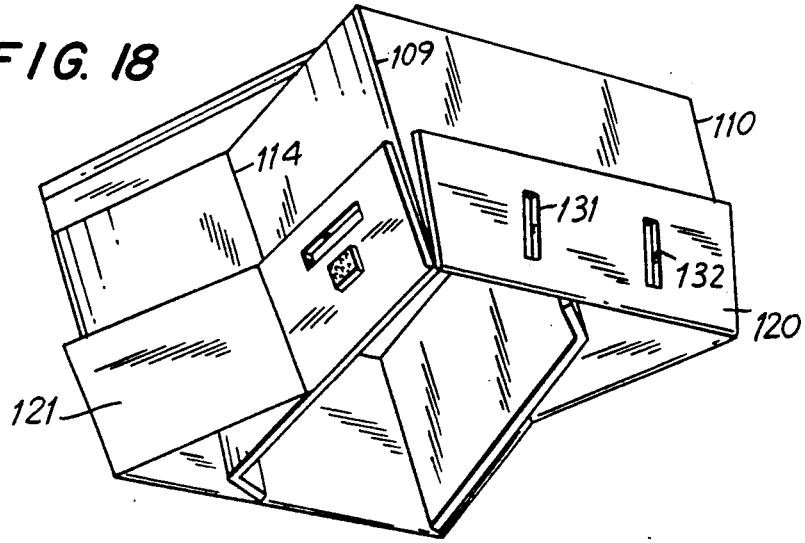
FIG. 18 is a perspective view showing a fourth stage of disassembly.

Turning now to the second embodiment of the invention, generally indicated by reference character 100 (FIGS. 11-19), a somewhat structurally stronger construction is disclosed which is intended for use in larger containers and correspondingly larger loads. The bottom wall structure provides selectively engageable tabs on the slip sheet which penetrate correspondingly aligned openings in the three flaps positioned thereabove to lock the bottom wall in erected condition. To provide for reuse of the containers, hook and pile engagement means maintains the tabs in engaged condition.

As in the first embodiment, the second embodiment includes a first outer lamina 101 and a second inner lamina 102. The construction is preferably of heavy-duty corrugated material, and the inner lamina, therefore, eliminates the additional ply positioned inwardly of the rigid walls of the outer lamina. As in the first embodiment, the outer lamina includes first and second rigid walls 104 and 105, third and fourth foldable walls 106 and 107 which are interconnected by vertical corner edges 108, 109, 110, and 111. The foldable walls 106 and 107 include vertically disposed fold lines 114 and 115, and with the walls 104 and 105, form a continuous upper edge 116. In the second element, the cover element (not shown) is not foldably interconnected to one of the rigid walls, but may be so if desired.

Connected to the lower peripheral edge 119, are first, second, and third flap members 120, 121, and 122 as well as the slip-sheet member 12 which includes first and second flaps 124 and 125 for selective forklift engagement, as is known in the art. The first flap member 120 is positioned opposite the slip sheet member, and is provided with first and second parallel slots 131 and 132. The flap members 121 and 122 are provided with only a single slot 135, and an inner surface 136 is provided with one part of mutually engageable hook and pile material 137.

The slip-sheet member 123 is provided with first and second foldable tabs 140 and 141 (see FIG. 14) each having a first fold line 142 and a second fold line 143 spaced apart a distance equivalent to the thickness of the lower wall to define a first vertical portion 144 and a second horizontal portion 145. One surface 146 is provided with a corresponding part of the hook and pile fabric at 147.

Assembly and disassembly of the second embodiment is generally similar to that in the first embodiment, as illustrated in the progressive stages shown in the drawings. Owing to the configuration of the second embodiment, the slip-sheet member 123 is not provided with a central fold line, as in the first embodiment, thereby providing for somewhat greater rigidity.

I wish it to be understood that I do rot consider the invention to be limited to the precise details of structure shown and set forth in this specification, for obvious modifications will occur to those skilled in the art to which the invention pertains.

I claim:

1. An improved collapsible reinforced shipping container comprising: a unitary blank of material forming first and second opposed rigid side walls, and third and fourth side walls interconnecting said first and second side walls to define continuous upper and lower peripheral edges, said third and fourth side walls each having a vertical medially-positioned fold line; said lower peripheral edge defining four rectilinear segments; first and second flaps hingedly connected to two of said rectilinear segments at said third and fourth side walls, said flaps having medially-disposed fold lines forming extensions of the fold lines of said third and fourth walls; a third flap hingedly connected to a third of said segments of said lower peripheral edge; a slip-sheet member foldably connected to a fourth of said segments of said lower peripheral edge, and adapted to underlie said first, second and third flaps, said slip-sheet member extending outwardly of said first wall to facilitate engagement of said container by a fork lift.

2. An improved collapsible shipping container comprising a first outer element and a second inner element; said outer element including a unitary blank of material forming first and second opposed rigid side walls, and third and fourth side walls interconnecting said first and second side walls to define upper and lower peripheral edges; said third and fourth side walls each having a vertical medially positioned fold line; an integral cover element hingedly connected to said upper peripheral edge and adapted to overlie said upper peripheral edge in closed condition; said lower peripheral edge defining four rectilinear segments; first and second flaps hingedly connected to two of said rectilinear segments bordering said third and fourth side walls, said flaps having medially positioned fold lines forming extensions of the fold lines of said third and fourth walls; a third flap hingedly connected to a third of said segments of said lower peripheral edge; a slip-sheet member foldably connected to a fourth of said segments of said lower peripheral edge and adapted to underlie said first, second and third flaps and extend outwardly of said first wall to facilitate engagement of said container by a fork lift; said inner element including two walls each of which is laminated to one of said third and fourth walls of said outer element on one side of said fold line, and being free of interconnection on an opposite side of said fold line, those portions which are free of interconnection terminating in a fold line, said fold line supporting a hinged flap, said fold line being positioned in a corner of said outer lamina when said container is in fully erected condition.

3. A container in accordance with claim 2, further comprising an integral cover element hingedly connected to said upper peripheral edge and adapted to overlie said edge in closed condition.

4. A container in accordance with claim 2, further comprising flexible tab members on said slip sheet member, said first, second and third flaps having slotted openings in aligned relation with respect to said tabs when said container is in erected condition to allow penetration therethrough, and selectively engageable fastening means on said tabs mating with corresponding means on an inner surface of at least one of said tabs to maintain said flaps and slip sheet in mutually parallel condition.

* * * * *